US007946084B2

(12) United States Patent
Gibson

(10) Patent No.: US 7,946,084 B2
(45) Date of Patent: May 24, 2011

(54) STAIR BRACKET SYSTEM AND METHOD

(75) Inventor: Sidney T. Gibson, Stratford (CA)

(73) Assignee: Sidney Gibson Limited, Stratford (CA)

( * ) Notice: Subject to any disclaimer, the term of this patent is extended or adjusted under 35 U.S.C. 154(b) by 397 days.

(21) Appl. No.: 11/626,657

(22) Filed: Jan. 24, 2007

(65) Prior Publication Data

US 2007/0113493 A1 May 24, 2007

Related U.S. Application Data

(63) Continuation-in-part of application No. 10/688,467, filed on Oct. 17, 2003, now abandoned, and a continuation-in-part of application No. 11/470,754, filed on Sep. 7, 2006, now abandoned.

(51) Int. Cl.
*E04F 11/00* (2006.01)
*E04F 19/00* (2006.01)

(52) U.S. Cl. ..... 52/187; 52/182

(58) Field of Classification Search ..... 52/182, 52/184, 185, 190, 188, 187
See application file for complete search history.

(56) References Cited

U.S. PATENT DOCUMENTS

| | | | | | |
|---|---|---|---|---|---|
| 1,363,418 | A | * | 12/1920 | Jacobs | 182/194 |
| 2,842,813 | A | * | 7/1958 | Van Fleet | 52/182 |
| 3,196,997 | A | * | 7/1965 | Hager | 52/182 |
| 4,015,687 | A | | 4/1977 | Dean | |
| 4,106,591 | A | * | 8/1978 | Cohen et al. | 182/93 |
| 4,362,232 | A | * | 12/1982 | Saito et al. | 198/333 |
| 4,422,270 | A | * | 12/1983 | Lapointe et al. | 52/182 |
| 4,519,490 | A | | 5/1985 | White | |
| 4,709,520 | A | | 12/1987 | Vochatzer | |
| 5,293,722 | A | * | 3/1994 | Reimann | 52/182 |
| 5,337,879 | A | * | 8/1994 | Fischer | 198/333 |
| 5,497,593 | A | * | 3/1996 | Riesberg | 52/702 |
| 5,791,101 | A | * | 8/1998 | Wallace | 52/191 |
| 5,806,254 | A | * | 9/1998 | Bennett | 52/182 |
| 5,983,580 | A | * | 11/1999 | Carr | 52/187 |
| 6,257,425 | B1 | | 4/2001 | Liu | |
| 6,230,454 | B1 | * | 5/2001 | Meagher | 52/182 |
| 6,543,599 | B2 | * | 4/2003 | Jasinetzky | 198/333 |
| 6,758,016 | B2 | | 7/2004 | Gobeil | |
| 2003/0029103 | A1 | * | 2/2003 | Wack et al. | 52/189 |
| 2003/0093959 | A1 | * | 5/2003 | Couture | 52/182 |
| 2003/0208971 | A1 | * | 11/2003 | Couture | 52/182 |
| 2005/0081461 | A1 | | 4/2005 | Gibson | |

* cited by examiner

*Primary Examiner* — Basil Katcheves
*Assistant Examiner* — Andrew J Triggs
(74) *Attorney, Agent, or Firm* — Standley Law Group LLP

(57) ABSTRACT

A stairway has a pair of stringers, mounted in inclined, spaced-apart, parallel relationship with at least one stair assembly, disposed in spanning relationship across the stringers. Each stringer has a top surface and a side surface. Each stair assembly has a pair of brackets and a tread with each end of the tread affixed to one of the brackets. Each bracket is mounted and affixed along a length of one of the stringers. Each of the brackets has a first and a second faces, which intersect in an angular manner. A flange is disposed perpendicularly from a side of the first face. When the bracket is mounted to the stringer, its first face and the flange are in abutting relationship with the respective top and side surface of the stringer. A further embodiment bracket has no flange extending from the first face.

2 Claims, 8 Drawing Sheets

STAIR BRACKET SYSTEM AND METHOD

CROSS-REFERENCE TO RELATED APPLICATIONS

This is a continuation-in-part of U.S. application Ser. No. 11/470,754, filed Sep. 7, 2006, now pending, which is in turn a continuation-in-part of U.S. application Ser. No. 10/688,467, filed Oct. 17, 2003, abandoned, both of which are incorporated herein by reference.

TECHNICAL FIELD

The invention relates generally to the assembly of a flight of stairs, and, more particularly, to a bracket suitable for such assembly.

BACKGROUND OF THE INVENTION

Typically, the construction of a flight of stairs has throughout the years involved cutting a pair of stair risers out of elongated pieces of lumber with right angular notches being cut into each piece at appropriate spacings before positioning and nailing down stair treads.

The building of staircases is time-consuming and the cutting of lumber requires great skill, care and craftsmanship. This cutting is often on a custom basis and is usually done offsite. This is all time consuming and is often the cause of delays in the course of construction projects.

Furthermore, flights of stairs constructed out of wood have been known to deteriorate, especially when used outdoors.

In light of the above, there is a need for a system and method for constructing flights of stairs easily on site avoiding the need for custom ordering offsite. There exists also a need for making the construction of staircases, or any similar type of construction, easy and convenient for the everyday handyman.

SUMMARY OF THE INVENTION

This and other objects of the invention are achieved by a stairway that has a pair of stringers and at least one stair assembly disposed in spanning relationship across the stringers. The stringers are mounted in inclined, spaced-apart, parallel relationship. Each stringer has a top surface and a side surface. Each stair assembly has a pair of brackets and a tread, with the tread having one of the brackets affixed to each end thereof. Each bracket is affixed along a length of each of the stringers.

Each of the brackets has a first and a second face in intersecting angular relationship, with a flange disposed perpendicularly from a side of the first face. The first face and the flange of each bracket are mounted in abutting relationship on the respective top and side surface of the stringer.

In some embodiments, the bracket has a further flange disposed in parallel relationship on the opposite side of the first face. In such an embodiment, the first face and the flanges are sized and adapted for abutting relationship on the respective top and both side surfaces of the stringer.

In the embodiments, the first and second bracket faces intersect at a back end of the bracket, with a supportive web disposed between the first and second faces along the length of each face.

In some embodiments, the web terminates at a front end of the bracket in an arcuate front face. In other embodiments, the web terminates at a front end of the bracket in a front face that is provided with a pair of mutually perpendicular surfaces for affixing a riser strip or light strip thereto.

In the embodiments, an aperture is provided in each flange for passage therethrough of a fastener affixing the bracket to the stringer, and an aperture is provided in each second face for passage therethrough of a fastener affixing the bracket to the tread. In some of the embodiments, an aperture is provided in each bracket for passage therethrough of a fastener affixing the bracket to a railing system component.

In many embodiments, the bracket comprises a thermoplastic material, especially a reinforced thermoplastic.

The angle of incline of the stringers and the angle between the first and second faces are substantially identical.

In many embodiments, each bracket of each pair of bracket is a mirror image of the other bracket, with respect to the placement of the flange on the first face. In some of these embodiments, each bracket of each pair is provided with corresponding mating means such that a pair of mirror image brackets can be accurately aligned in a ganged fashion.

BRIEF DESCRIPTION OF THE DRAWINGS

The invention will be better understood through reference to the exemplary embodiments disclosed herein, wherein identical parts are identified by identical part numbers, and wherein.

DETAILED DESCRIPTION OF A PREFERRED EMBODIMENT

Figure 1:
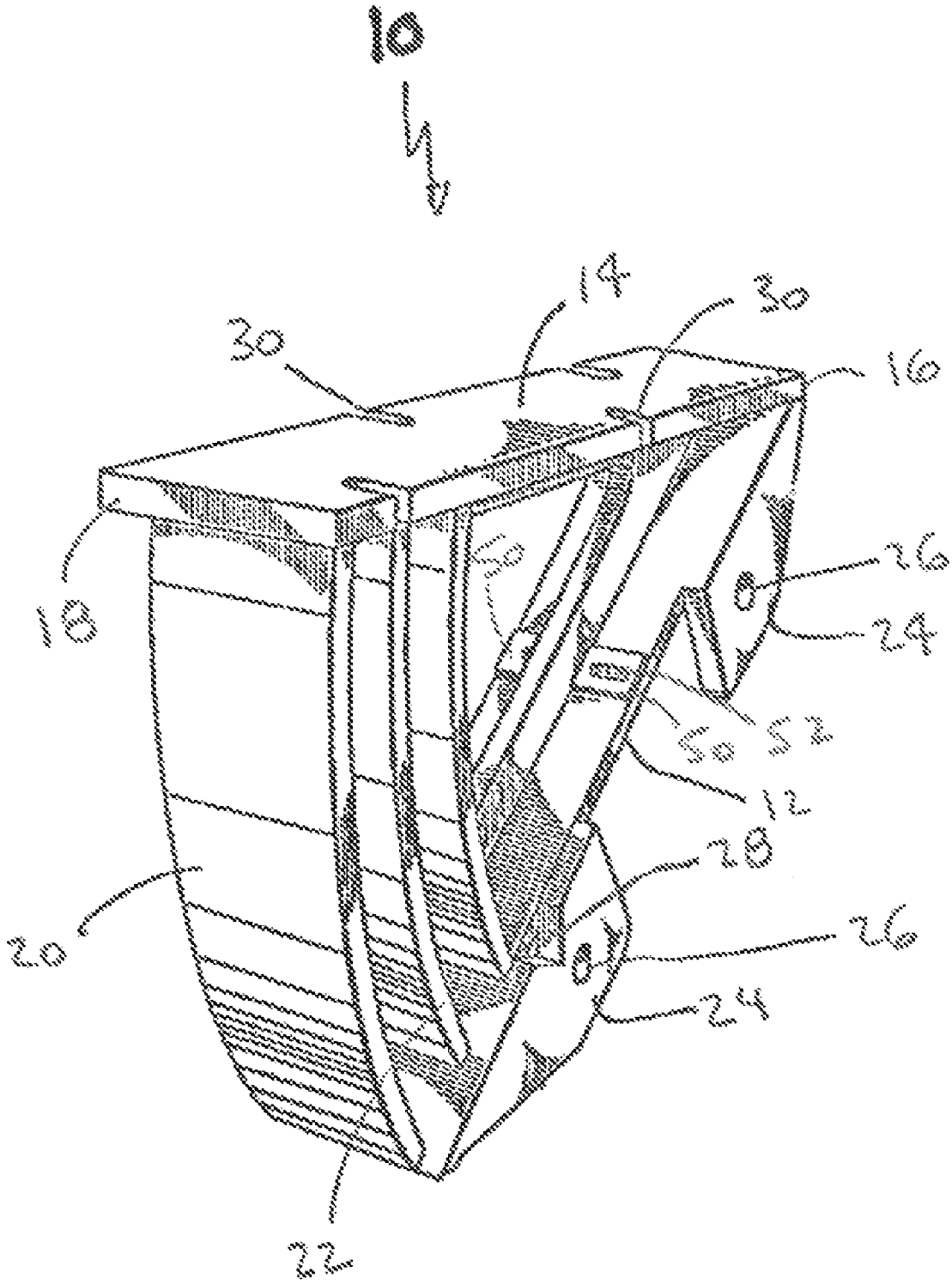
FIG. 1 is a front perspective view of a first exemplary embodiment of a bracket.
Figure 2:
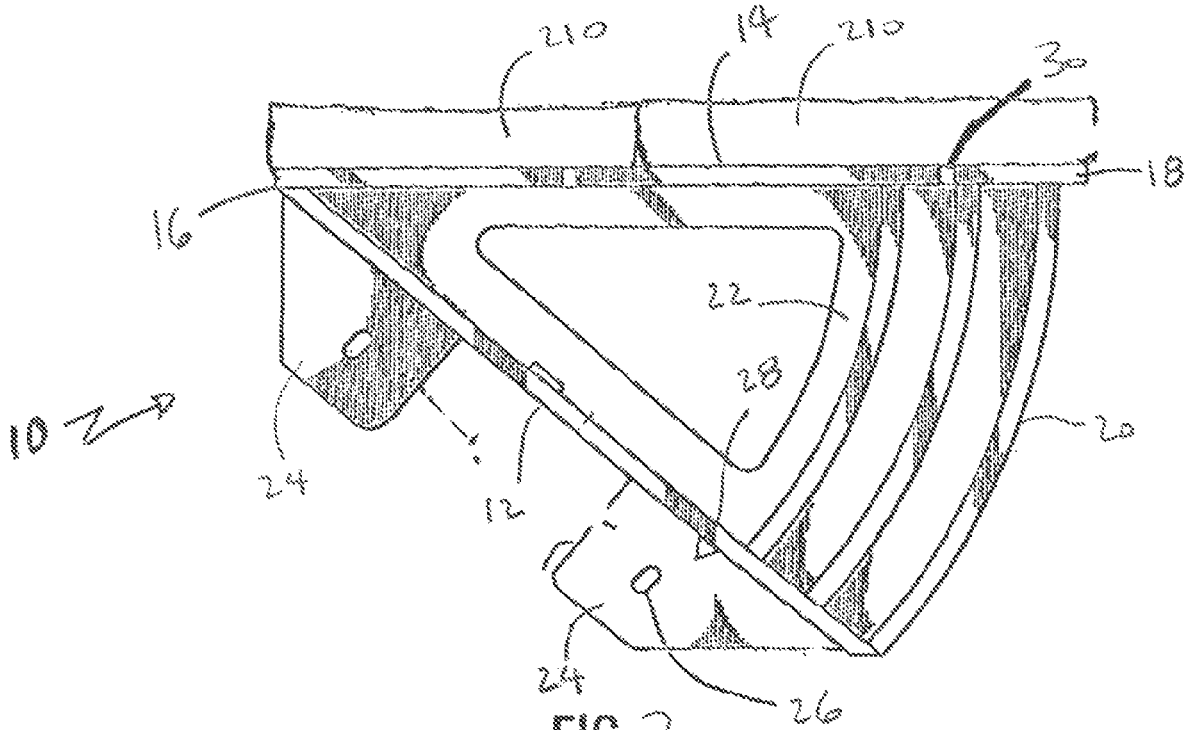
FIG. 2 is a side elevation view of the FIG. 1 bracket and the structural member to be connected thereto.

Referring first to FIGS. 1 and 2, a first exemplary embodiment of a bracket 10 intended for use in constructing a flight of stairs is illustrated. The bracket 10 has a first face 12 and a second face 14, the faces being in angular intersecting relationship, so the first and second faces meet at a back end 16. At a front end 18, first and second faces are connected by a front face 20, which is shown in this embodiment as an arcuate member. As best seen in FIG. 2, the first and second faces 12, 14 are of substantially the same length, but with second face 14 being at least as long as first face 12, since the faces 12, 14 are radii of a circle sector having a center at or near back end 16 and front face 20, that serves as the connecting arc. In addition to arcuate front face 20, there may be additional support provided between the first and second faces 12, 14. This additional support will be referred to generally as web 22. Bracket 10 may be provided in mirror-image pairs, the two brackets in a pair being distinguishable by the placement of at least one flange 24 that extends below first face 12 on one side of the bracket. As is clearly noted, each flange 24 is disposed perpendicular to first face 12 and the flange is provided with an aperture 26. The bracket 10 is also provided with an indexing window 28 along a flange 24, the indexing window being useful for aligning the bracket accurately to a pre-measured mark on a stringer during installation. As best seen in FIG. 1, the second face 14 is provided with at least two apertures 30. In this embodiment, apertures 30 are disposed normal to second face 14.

FIG. 1 also shows a pair of raised bosses 50, each with a slotted aperture 52 therethrough. One of the bosses 50 and apertures 52 are provided on each side of web 22 on an internal side of first face 12. While not specifically used in the embodiment, this boss 50 and aperture 52 can be very useful in providing attachment of the bracket 10 to a stair system.

FIG. 2 also shows two treads 210, as they would be positioned atop bracket 10, in the manner described below.

Figure 3:
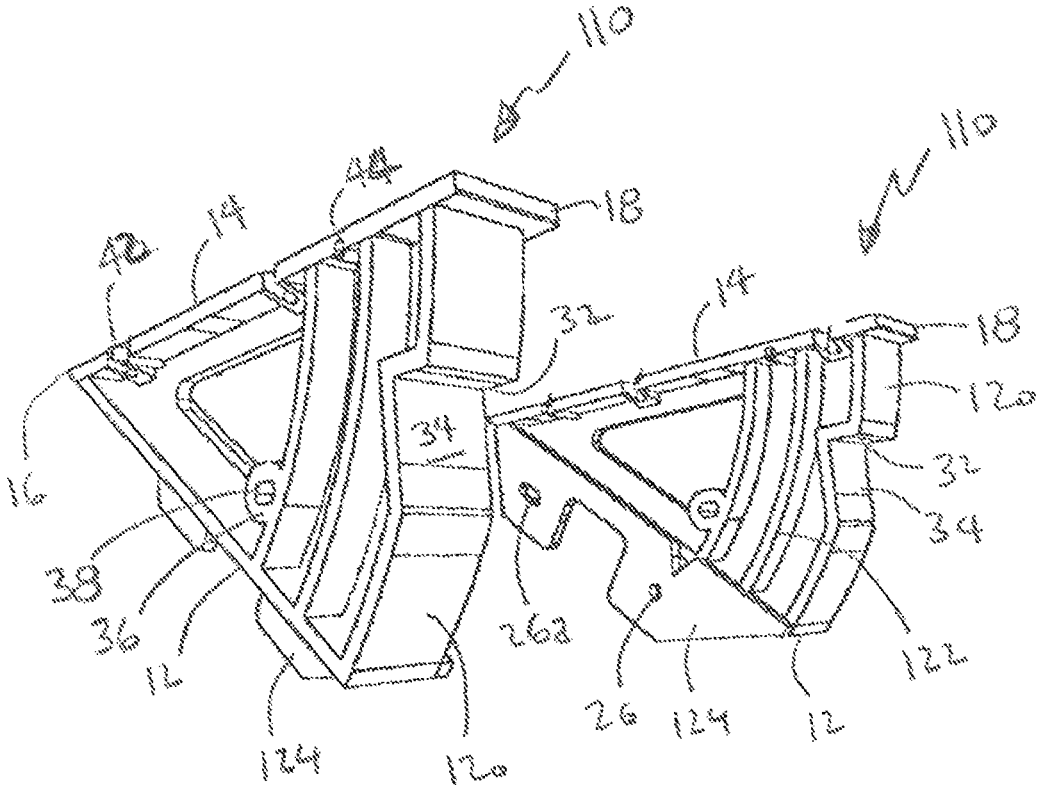
FIG. 3 is a front perspective view of a pair of a second exemplary embodiment of the bracket.
Figure 5:
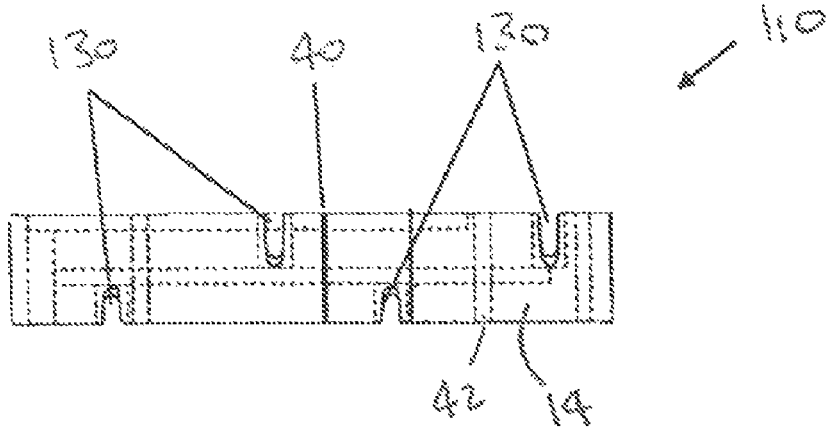
FIG. 5 is a top plan view of one of the FIG. 3 brackets.
Figure 4:
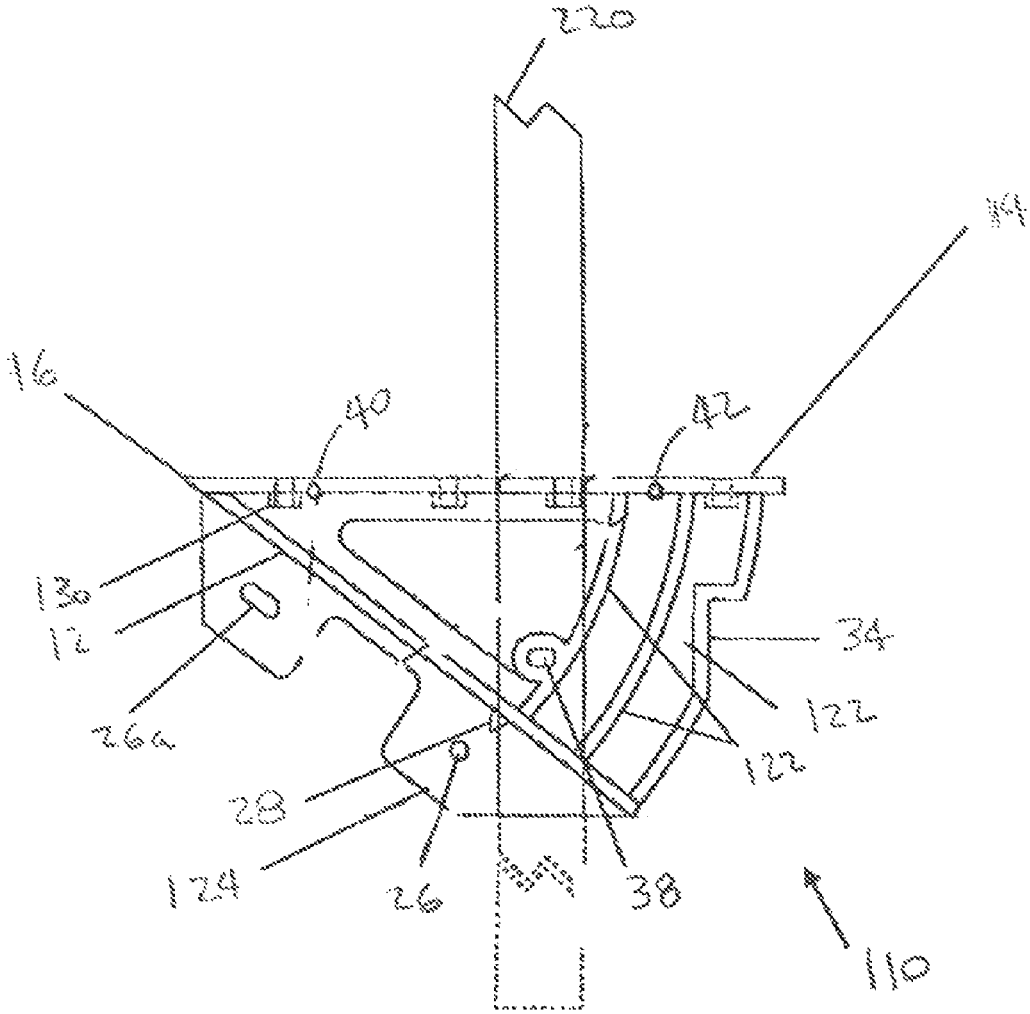
FIG. 4 is a side elevation view of one of the FIG. 3 brackets.

A second exemplary embodiment bracket 110 is seen in FIGS. 3 through 5. FIG. 3 shows a front perspective view of a pair of the second embodiment brackets 110 in a manner that illustrates the mirror-image configuration, as was noted regarding bracket 10. Each bracket 110 has a first face 12 and a second face 14, the faces being in angular intersecting relationship, so the first and second faces meet at a back end 16. At a front end 18, first and second faces are connected by a front face 120. Unlike front face 20 of bracket 10, front face 120 is not smoothly arcuate. Instead, the front face 120 has a pair of mutually perpendicular surfaces 32, 34, that facilitate the installation of a riser strip or light strip. Of these surfaces, surface 32 is parallel to second face 14. As in bracket 10, bracket 110 has additional support provided between the first and second faces 12, 14 by web 122, which is generally the same as web 22 of bracket 10, but is shown in FIGS. 3 and 4 as having an optional additional boss 36, which is provided with an aperture 38.

As with bracket 10, bracket 110 is provided with at least one flange 124 that extends below first face 12 on one side of the bracket. Flange 124 is disposed perpendicular to first face 12 and the flange is provided with at least one aperture 26. One of the apertures, designated 26*a*, has a slotted profile, instead of the circular profile illustrated in the other apertures 26. This feature provides for minor adjustment of the bracket height and can compensate for warpage, size variations, etc. in the other materials. Bracket 110 is also provided with indexing window 28 along flange 124, the indexing window being useful for aligning the bracket accurately to a pre-measured point on a stringer during installation.

As best seen in FIG. 5, second face 14 is provided with at least two apertures 130. Unlike apertures 30, apertures 130 are shown in an oblique angle relative to second face 14, which allows angled installation on mounting screws to secure a tread atop the second face. An optional feature, shown in FIG. 5, but not illustrated in FIG. 1, is a tread centerline marker 40.

FIG. 4 also shows component of a railing system, namely, a baluster 220, which may be affixed to the bracket 110, especially through aperture 38.

It will be clear to those of skill in this art that either embodiment of bracket 10, 110 is suitable to be manufactured by conventional molding techniques, especially molding of thermoplastic, and especially reinforced thermoplastic materials. The use of an insect- and water-resistant material will provide maximum potential strength and rigidity in a non-rotting configuration. In a preferred case, the bracket 10, 110 will be molded from a reinforced plastic material. Construction from die-cast and/or fabricated metal and other materials will also be known to those of skill.

Figure 6:
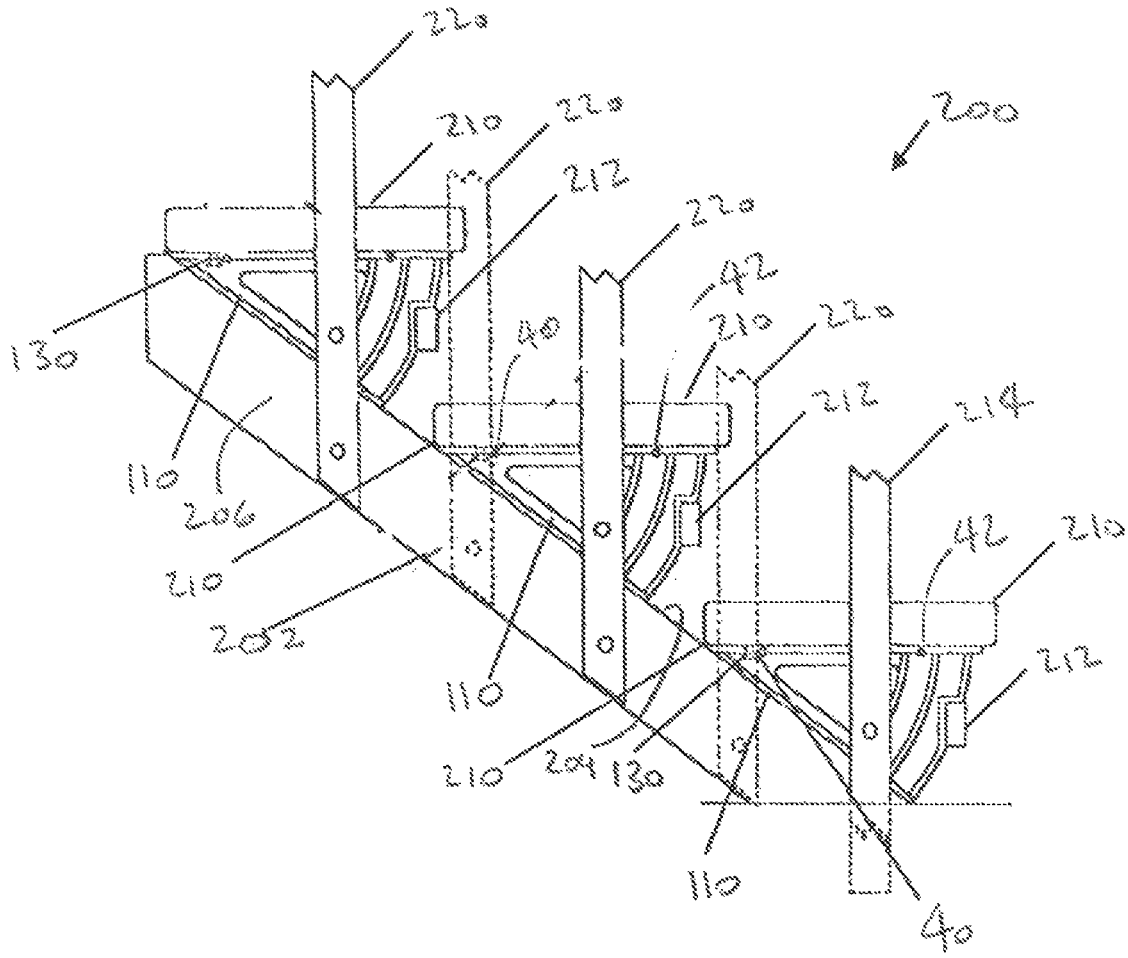
FIG. 6 is a side perspective view of a flight of stairs, constructed using the bracket of FIG. 3.

FIG. 6 provides a side elevation view of an exemplary flight of stairs 200 constructed using pairs of brackets 110. It is evident from FIG. 6 that each of the brackets 110 shown will be paired with a mirror-image partner that is not seen in FIG. 6. The mirror-image pairs of brackets 110 are attached in a secure manner to a pair of parallel stringers 202 that have been positioned and secured in the angled manner shown in FIG. 6 before the brackets are installed. While stringers 202 will typically be wood, other materials of construction will be a design choice of one of ordinary skill. Each stringer 202 has a planar top surface 204 and a pair of opposing side surfaces 206.

Stringers 202 are installed so that a longitudinal centerline is inclined at an angle to the horizontal. This angle, also referred to as the "pitch" of the stringer, will be equivalent to the angle between the first and second faces 12, 14 of the bracket 10, 110 selected for use. For this reason, brackets 10, 110 may be manufactured with varying angularity between the first and second faces 12, 14, without affecting the utility.

Locating individual brackets 10, 110 along the respective structural members will be well-known to one of skill in this art, and will, in many aspects, be dictated by local building codes.

After marking off the intended position of all of the bracket pairs, or at least after marking off the position of a first pair of the brackets 110, the first pair will be attached to the respective stringers 202. In a preferred placement, a bracket 110 will be placed on a stringer 202 with the first face 12 of the bracket seated atop the angled top surface 204 and the flange 124 is flush against a side surface 206, with bracket back end 16 also contacting top surface 204. Each aperture 26 on flange 124 provides a fastening site for joining the bracket 110 to stringer 202. As noted above, the exact structure and size of flange 124, including the number of apertures 26 is a matter of design choice. While the illustrated brackets 10, 110 are provided in mirror image pairs with a flange 24, 124 provided on only one side thereof, a bracket having flanges on both sides to provide an "inverted-U" shaped channel may be appropriate and useful. In such an instance, the channel, comprising the first face 12 and the flanges 24, 124 would straddle top surface 204 and the bracket pairs will be identical rather than mirror images.

In an exemplary assembly embodiment, the bracket pairs will all be installed, forming a stairway framework, before the treads 210 are installed. With each pair of brackets 110 in place, the second faces 14 on the bracket pair 110 are ready for installation of treads 210. These second surfaces 14 provide parallel, aligned planar surfaces horizontal to the floor, so one or more treads 210 spanning the gap between the surfaces may be affixed. The apertures 30 or 130 provide a fastening site through which any suitable fastener may be passed into the underside of the tread 210 lying directly atop second surface 14. Screws are typically preferred. It is readily notable that the shape of the brackets 110 makes each stair assembly of brackets and treads 210 structurally independent of any other stair assembly positioned on the stringer 202.

Also shown attached to brackets 110 are a number of riser strips 212.

In other embodiments, individual steps, including the brackets 24, 124 and the tread 210, will be fully assembled before the next set of brackets will be placed on stringers 202.

FIG. 6 also shows at least a partial railing system that may be attached to the flight of stairs as assembled using the inventive elements. The railing system, which is preferably completed after all steps are affixed, comprises newel posts (a bottom newel post 214 shown), a plurality of balusters 220, placed intermediate the newel posts, and a handrail (not shown). The newel posts 214 are distinguished from the balusters in that they typically are larger than the balusters, are positioned at the ends of the stairs, and effectively anchor the handrail independent of the stringers 202. The balusters 220 may be attached to the stringers 202, the brackets 110, or both. In FIG. 6, a number of balusters 220 are shown to provide environment for their placement in a typical application. As would be expected, the handrail, if shown, would be inclined in a manner parallel to stringers 202.

There may be a need to accurately align a pair of side by side brackets 10, 110. Mating means, shown illustratively in FIGS. 3 through 6 as projections 42 and correspondingly opposite matching recesses 44 allows for this option. These mating means are arranged to dispose flanges 124 on the respective first faces 12 in opposing parallel relationship on the outside of the combined pair rather than in abutting relationship internal to the first face.

Figure 7:
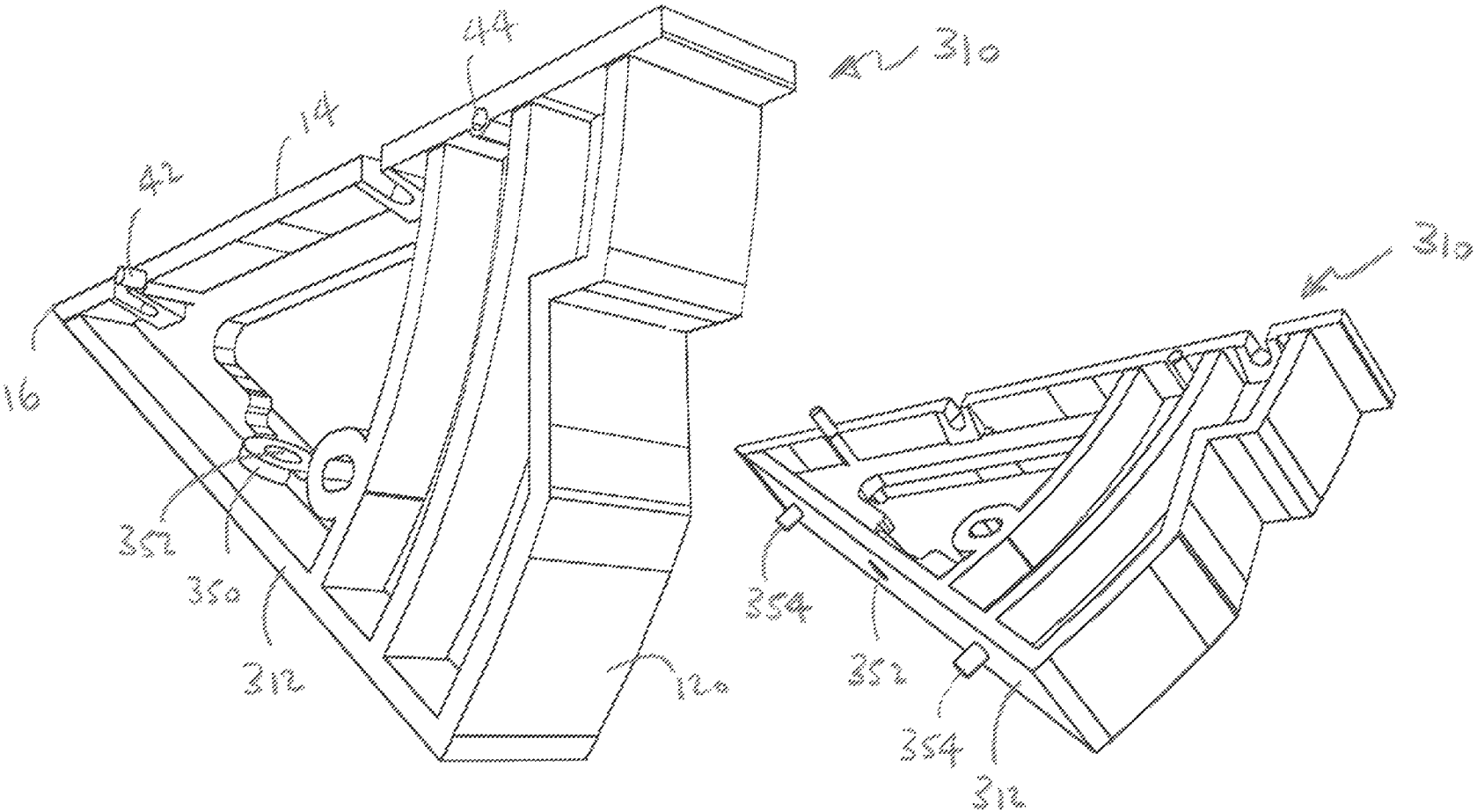
FIG. 7 is a front perspective view of a pair of a third exemplary embodiment of the bracket, with one of the brackets tipped to reveal additional features.

FIG. 7 provides a front perspective view of a pair of a third exemplary embodiment of a bracket 310 intended for use in constructing a flight of stairs is illustrated. In this Figure, the right bracket of the pair is tipped to the side to show features on the underside of the first face 312 that would otherwise not be visible. The bracket 310 also has a second face 14 that is identical to the second face used in the other bracket embodiments 10, 110, so no further description of it is warranted. In fact, many features are the same as those in FIG. 1 or FIG. 3, and they are identified by the identical reference numbers without repeating the description here. A primary difference of bracket 310 is the absence of the flanges that extend below the first face in the previous embodiments. Because the flanges are not present, at least one boss 350, with a round aperture 352 is used to connect the bracket 310 to a stringer by providing a passage for a fastener. As seen on the underside of the first face 312, this aperture may be assisted in aligning and connecting the bracket by the placement of at least one tang 354 that extends out from this underside, to fit into a predrilled hole on a top surface of the stringer. While it is possible to manufacture just one model of bracket 310 (instead of manufacturing mirror image models), the illustrated embodiment shows mating means, that is, projections 42 and correspondingly opposite matching recesses 44 to allow for the brackets 310 to be ganged together in groups of two or even more, thereby providing additional support when needed. In one variation on this, all of the mating means can be recesses 44, and pegs (not shown) can be inserted in a pair of corresponding recesses. This variation allows one model of bracket to be mated with itself in the ganging process.

Figure 8:
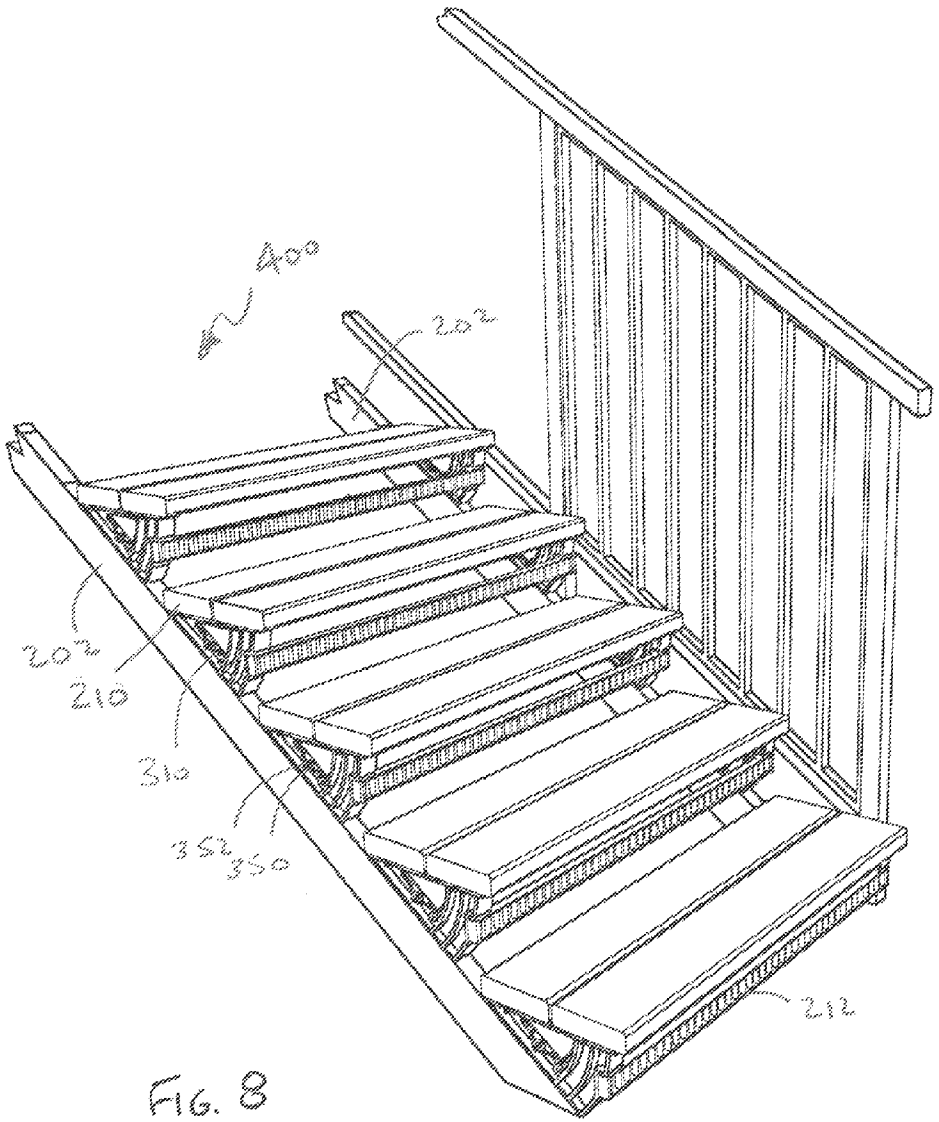
FIG. 8 is a side perspective view of a third exemplary embodiment of the bracket, shown in use in a straight flight of stairs using two stringers.

A first use of this third exemplary embodiment bracket 310 is shown in FIG. 8, which is a side elevation view of an exemplary flight of stairs 400 constructed using pairs of brackets 310. A pair of brackets 310 provides the attachment for stair treads 210 that span a pair of parallel stringers 202. Each bracket 310 is attached to one of the pair of parallel stringers 202 through the apertures 352 in bosses 350. In some situations, more than one pair of bosses 350 and apertures 352 will be provided along the internal side of first face 312. FIG. 8 also shows an embodiment of bracket 310 in which the front face is like front face 120 of FIG. 3, so that a riser strip 212 may be attached thereto.

Figure 9:
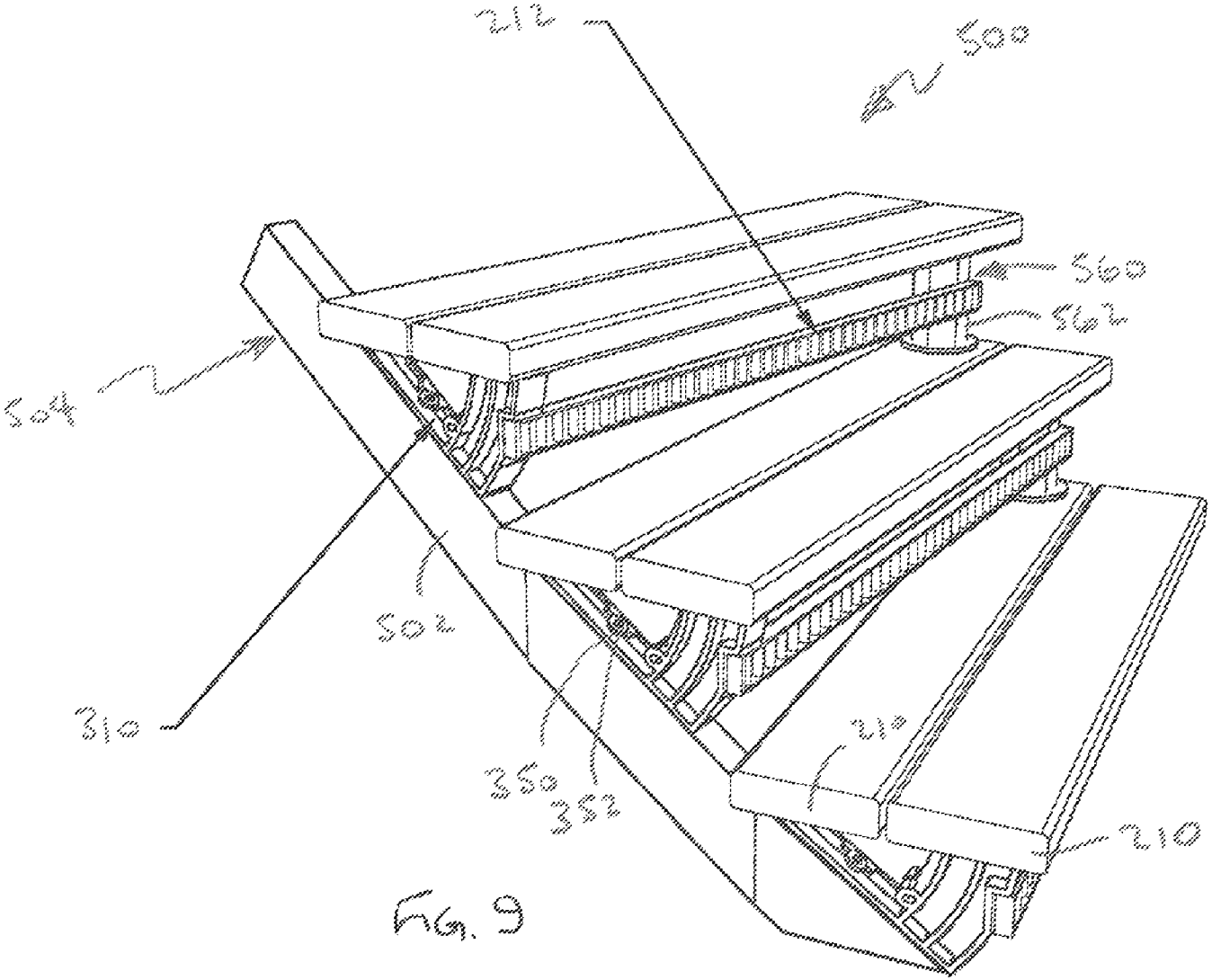
FIG. 9 is a side perspective view of the third embodiment bracket, shown in use in a curved flight of stairs using only one stringer.

A further use of the third exemplary embodiment bracket 310 is shown in FIG. 9, which is a side elevation view of an exemplary spiral flight of stairs 500 that may be constructed using individual brackets 310. Each bracket 310 provides the attachment for one end of stair treads 210 to one of several stringer portions 502 that combine to provide a spiral stringer 504. The second end of each of the stair treads 210 is supported by a stanchion member 560, which has an upright portion 562 that vertically spans the vertical distance between a pair of adjacent stair treads and a plate member (not visible in FIG. 9) that serves a function equivalent to that of the second face of the brackets, that is, it underlies second ends of the stair treads. As in the earlier embodiment of FIG. 8, bracket 310 is attached to one of the respective stringer portion 502 through the apertures 352 in bosses 350.

Other embodiments and uses of the invention will be apparent to those skilled in the art from consideration of the specification and practice of the invention disclosed herein. The specification and examples should be considered exemplary only and do not limit the intended scope of the invention.

What is claimed is:

1. A stairway, comprising:

a spiral stringer, comprising a plurality of stringer portions attached end to end, each stringer portion having a top surface and a side surface; and at least two stair assemblies disposed on the spiral stringer, each stair assembly comprising:

a bracket, comprising a first and a second planar face that intersect angularly at a back end of the bracket with a supportive web disposed therebetween and a flange disposed perpendicularly from a side of the first face, the bracket provided with at least one aperture through the first face to mount the flange and first planar face in abutting relationship along respective side and top surfaces of the spiral stringer;

a tread, having an outer end thereof affixed to the bracket; and a stanchion member, an inner end of the tread attached thereto, the stanchion member connecting the tread to the tread of a vertically adjacent stair assembly, such that a longitudinal axis of each stanchion member is offset from the axis of the stanchion member of each adjacent stair assembly.

2. The stairway of claim 1, wherein:

each tread comprises a first and a second tread member in adjacent parallel relationship;

each stanchion member connects the first tread member of one of the stair assemblies to the second tread member of the adjacent stair assembly.

* * * * *